US005133246A

United States Patent [19]

Campbell

[11] Patent Number: 5,133,246

[45] Date of Patent: Jul. 28, 1992

[54] CONTROL SYSTEM

[76] Inventor: Charles R. Campbell, Rte. 1 Box 118D, Stony Point, N.C. 28678

[21] Appl. No.: 660,062

[22] Filed: Feb. 25, 1991

[51] Int. Cl.[5] ..... B05B 15/12

[52] U.S. Cl. ..... 454/52; 454/53; 454/188

[58] Field of Search ..... 98/36, 115.2; 118/326

[56] References Cited

U.S. PATENT DOCUMENTS

| | | | |
|---|---|---|---|
| 1,748,161 | 2/1930 | Whitmore | 98/36 X |
| 1,989,270 | 1/1935 | Clark | 98/115.2 |
| 2,014,962 | 9/1935 | Bramsen | 98/115.2 |
| 2,119,282 | 5/1938 | Ludwig | 98/115.2 |
| 4,048,912 | 9/1977 | Walker | 98/115.2 |

FOREIGN PATENT DOCUMENTS

| | | | |
|---|---|---|---|
| 994034 | 2/1983 | U.S.S.R. | 118/326 |
| 2028177 | 3/1980 | United Kingdom | 118/326 |

*Primary Examiner*—Harold Joyce

[57] ABSTRACT

A control system for controlling capturing and disposing of volatile organic compounds ("VOC's") and other substances that includes a spray booth having an entrance, an exit, an accessible working area and one or more areas adjacent the working area, the use of air curtains to provide invadable spray booth sealing closures at the entrance, exit, working and adjacent areas, an interior air flow supply means directing air flow generally in the direction of the article to be sprayed to move the floating particles and vapors in a decided direction, air evacuation means to recycle the supplied air and remove the VOC's and other substances entrained therein to a remote location, and means to dispose of the VOC's and other substances evacuated from the control system.

23 Claims, 11 Drawing Sheets

CONTROL SYSTEM

BACKGROUND OF THE INVENTION

1. Field of the Invention

The present invention relates to environmental systems and more particularly, to a system for the control, capture, and disposal of volatile organic compounds ("VOC's") and other substances in spray booths. The system embodies the use of air curtains to retain VOC's and other substances within a defined spray booth interior and prohibit their dispersion to the surrounding environment.

2. Description of the Prior Art

Capturing VOC's includes anything that is used to keep solvent vapors from becoming fugitive. Devices that can accomplish that objective include such things as exhaust hoods, side baffles and the like. Good capture results can be achieved by using a large quantity of air to deal with a relatively small quantity of VOC's. Unfortunately, this is an expensive operation and not practicable for most manufacturers.

Particularly troublesome are vapors emitted from paint and finish spraying processes utilized, for example, in the automobile and furniture industry. The articles to be painted and finished are confined in a small enclosed area, and operators may spray numerous coats of various surface coverings over a period of time. As these coatings are applied, vapors arise from the drying process and need to be evacuated from the working area as quickly as possible. A great deal of research has been done in this area, and reference is made to an article by Roy J. McIlwee and Richard C. Sharp entitled THE BASICS OF VOC CAPTURE SYSTEMS as well as a technical paper published by The Society of Manufacturing Engineers labelled VC87-649 and entitled VOC EMISSION CONTROLS FOR PAINT SPRAY BOOTHS for background information and current practices used in this technology. The problems encountered in this field are identified and discussed in detail, and various solutions are proposed. While the problems for the most part can be solved and reduced significantly, the undertaking is inordinately expensive and available therefore to only the most affluent manufacturers.

The present invention addresses the need to economize the process of containing VOC's and other substances arising as a result of the spraying operation and disposing of them efficiently and economically.

SUMMARY OF THE INVENTION

The purpose of the present invention is to provide a new and improved VOC and spray-created substances control system which has all of the advantages of prior art systems and none of the disadvantages. To attain this purpose, various embodiments of the present invention are illustrated in the drawings all of which principally make use of a spray booth having entrance, exit, and accessible working and areas adjacent thereto isolated from the exterior environment by air curtains strategically located to prevent the flow of internally supplied air and VOC's and other substances entrained therein to the surrounding environment. The system comprises a spray booth which has an entrance, an exit and an accessible working area and one or more adjacent areas functional therewith, air curtains providing invadable spray booth sealing closures for the entrance, exit, working, and adjacent areas, an interior air flow supply means directing air flow generally in the direction of the article to be sprayed, and air evacuation means to circulate the incoming air and remove it with the entrained VOC's and other substances arising as a result of the spraying operation. The removed air and entrained materials are ultimately directed to a combustion means which ignites the volatile substances and disposes of them efficiently and economically.

Thus, there has been outlined, rather broadly, the more important features of the invention in order that the detailed description thereof that follows may be better understood, and in order that the present contribution to the art may be better appreciated. There are, of course, additional features of the invention that will be described hereinafter and which will also form the subject matter of the claims appended hereto. In this respect, before explaining one or more embodiments of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the concept, upon which this disclosure is based, may readily be utilized as a basis for the design of other structures, methods and systems for carrying out the several purposes of the invention. It is important, therefore, that the claims be regarded as including such equivalent constructions insofar as they do not depart from the spirit and scope of the present invention..

Further, the purpose of the accompanying ABSTRACT is to enable the United States Patent and Trademark Office and the public generally, and especially the scientists, engineers, and practitioners in the art who are not familiar with patent or legal terms or phraseology, to determine quickly from a cursory inspection the nature and essence of the technical disclosure of the application. The ABSTRACT is neither intended to define the invention set forth in this application, which is measured by its claims, nor to be limited as to the scope of the invention it briefly describes.

It is therefore an object of the present invention to provide a new and improved VOC and spray-created substances control system which has all of the advantages of prior art systems and none of the disadvantages.

It is another object of the present invention to provide a new and improved system which utilizes air curtains to contain contaminants or other substances within the working area of the spray booth for eventual evacuation and destruction.

It is a further object of the present invention to enable the use of extremely low air flow volumes in comparison with the air flow volumes required by present systems to accomplish the stated objective.

It is still another further object of the present invention to provide a new and improved control system which is of a durable and reliable construction, which is configured to maximize utilization time, and which is far more economical to construct and operate.

These objectives, together with other objects of the invention, along with the various features of novelty which characterize the invention, will become more apparent after consideration of the following detailed description of the invention considered with the accompanying drawings and their description in which like characters of reference designate like parts throughout the several views.

BRIEF DESCRIPTION OF THE DRAWINGS

The invention will be better understood and objects other than those set forth above will become apparent when consideration is given to the following detailed figure description. Such description makes reference to the annexed drawings wherein.

The drawings described will be referred to herein as various embodiments of the present invention. They represent various ideas and combinations utilizing and illustrating the present invention.

DESCRIPTION OF THE PREFERRED EMBODIMENTS

Figure 14:
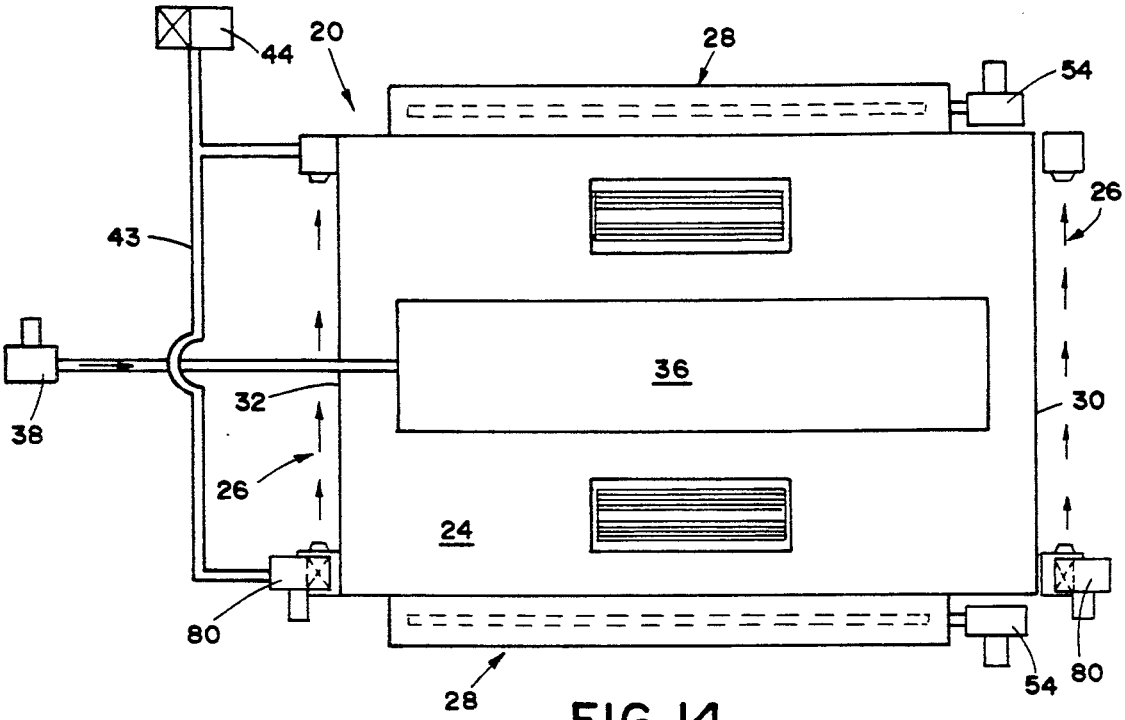
FIG. 14 is a plan and schematic view of the embodiment of the control system comprising the present invention shown in FIGS. 1, 2, and 13.
Figure 13:
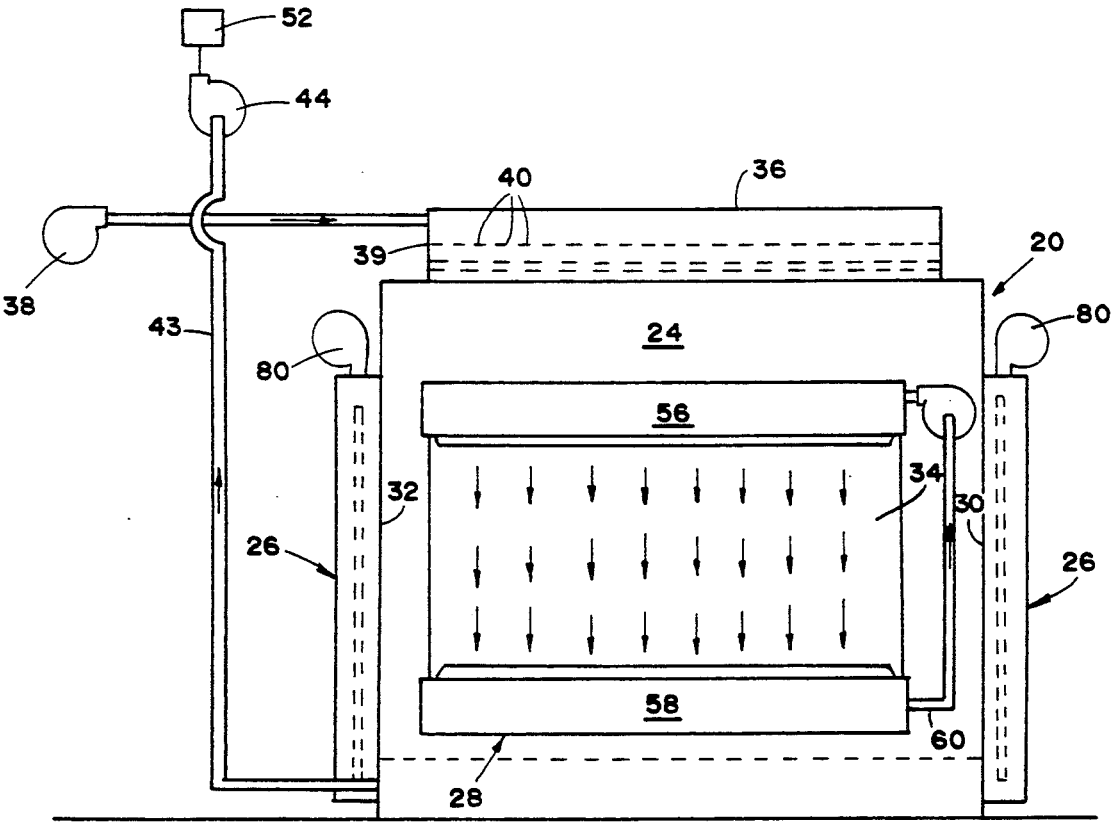
FIG. 13 is a side elevational and schematic view of the embodiment of the control system comprising the present invention shown in FIGS. 1 and 2.

Referring now to the drawings, and in particular to FIGS. 13 and 14, a spray booth shown generally as 20 is positioned on a supporting surface 22. The spray booth housing 24 carries a plurality of air curtains shown generally as 26, 28. Air curtains 26 close spray booth entrance 30 and exit 32, while air curtains 28 cover openings 34 (which may be on one or both sides) in spray booth housing 24.

Figure 8:
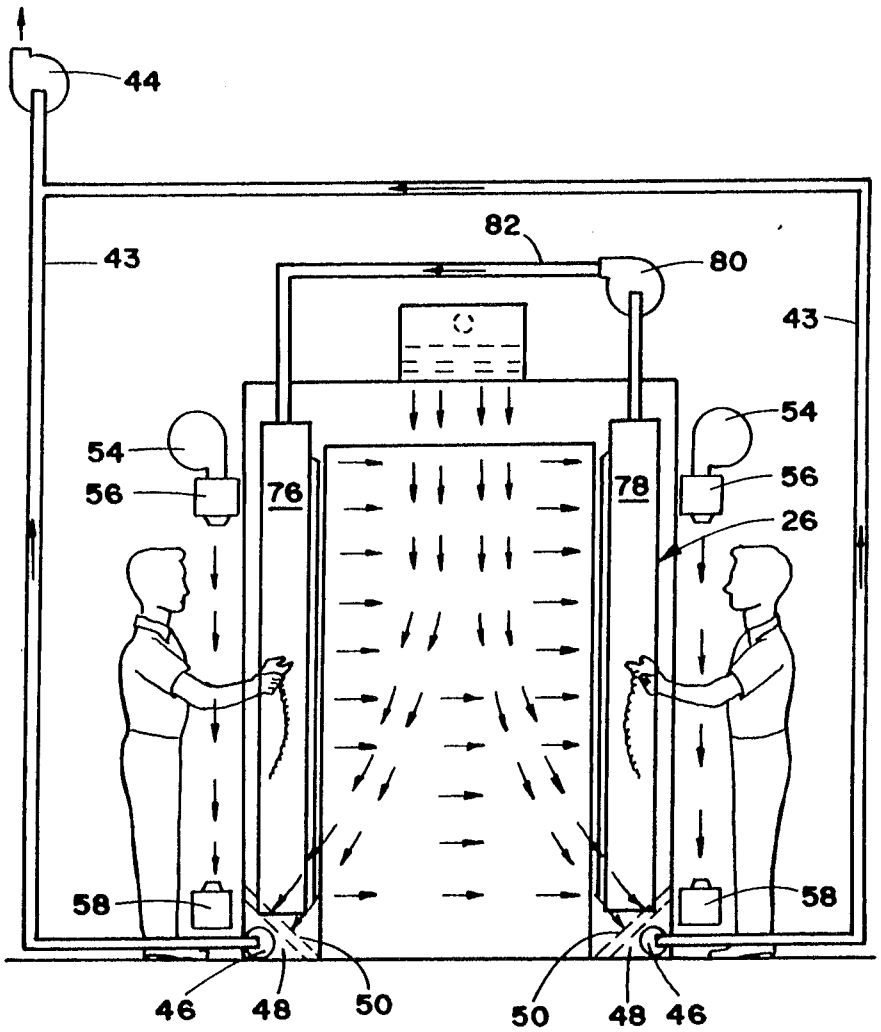
FIG. 8 is an end elevational and schematic view of the embodiment shown in FIG. 7 utilizing two spraying operators positioned in a face-to-face relationship on either side of the spray booth interior.
Figure 7:
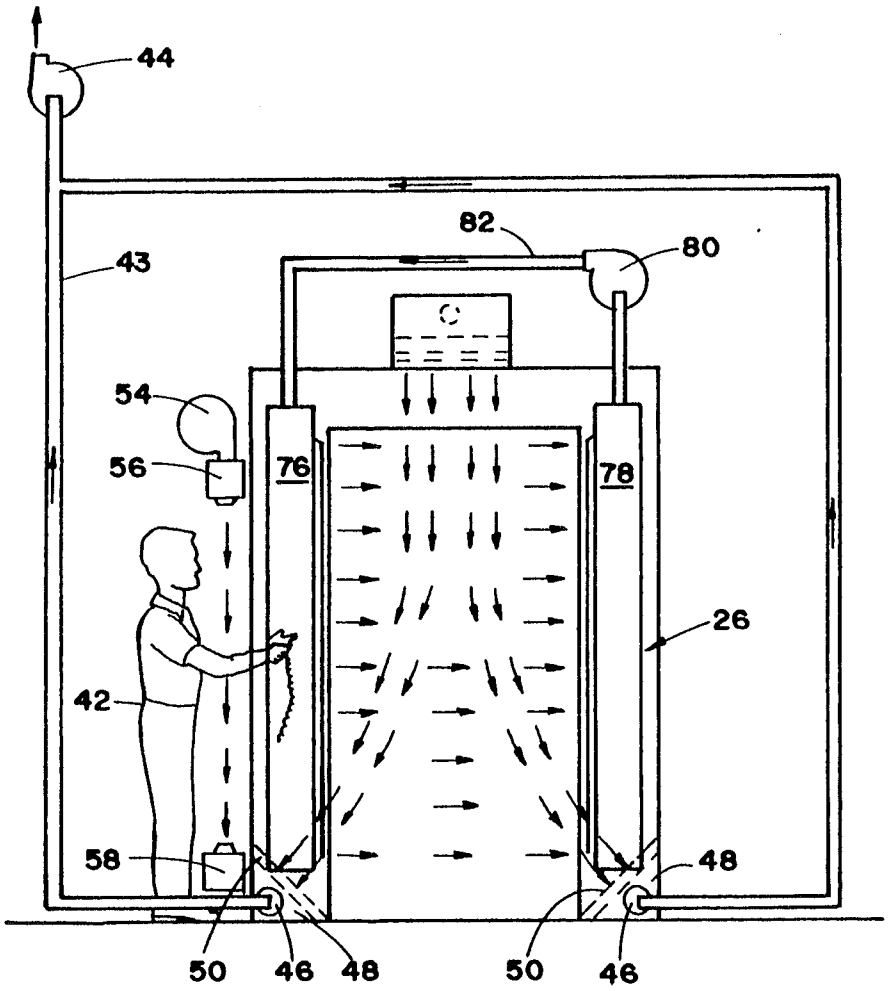
FIG. 7 is an end elevational and schematic view of another embodiment of the control system comprising the present invention having an above floor dual air flow and substance exhaust and utilizing a recirculatory air curtain design.
Figure 10:
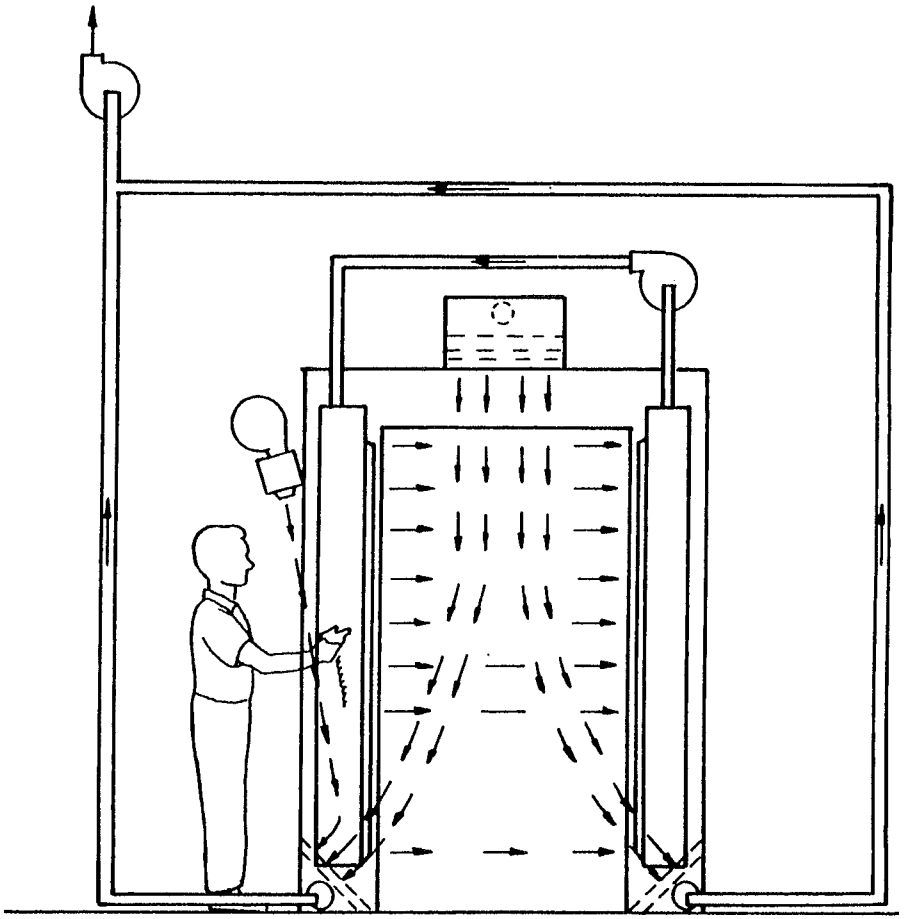
FIG. 10 is an end elevational and schematic view of another embodiment of the control system comprising the present invention having an above floor dual exhaust wherein the air curtain air flow enters that return.
Figure 9:
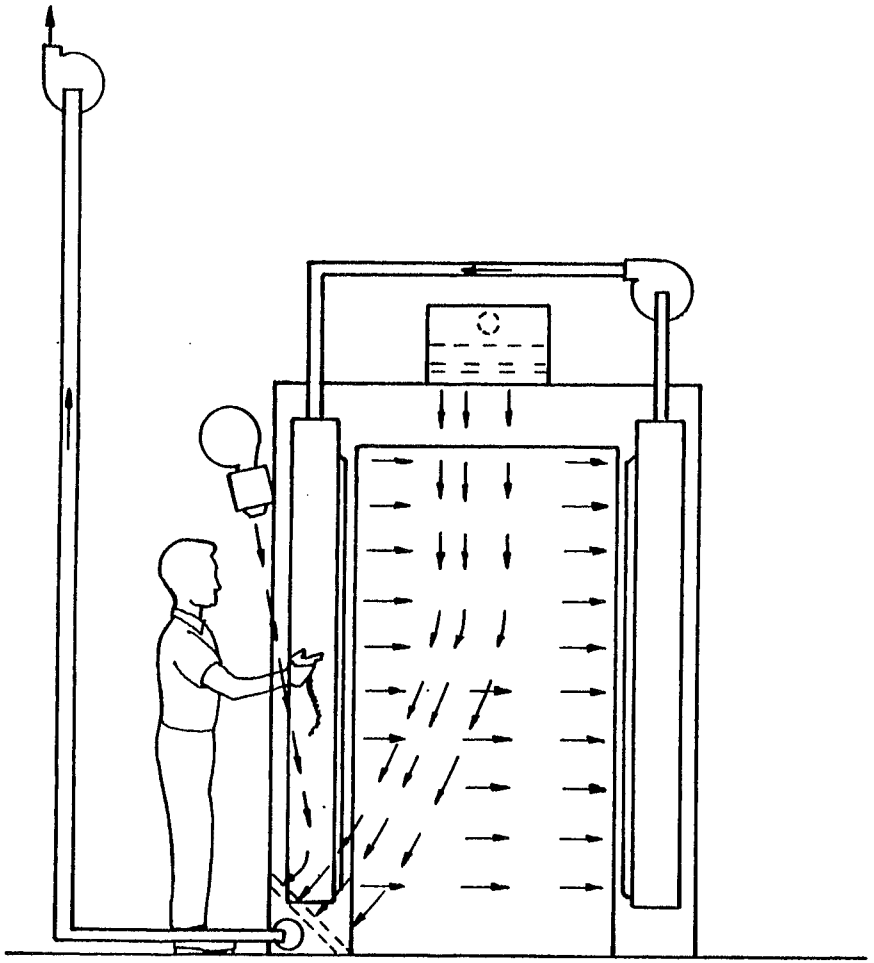
FIG. 9 is an end elevational and schematic view of another embodiment of the control system comprising the present invention having an above floor single air flow exhaust and an air curtain wherein the air curtain air flow enters that return.
Figure 12:
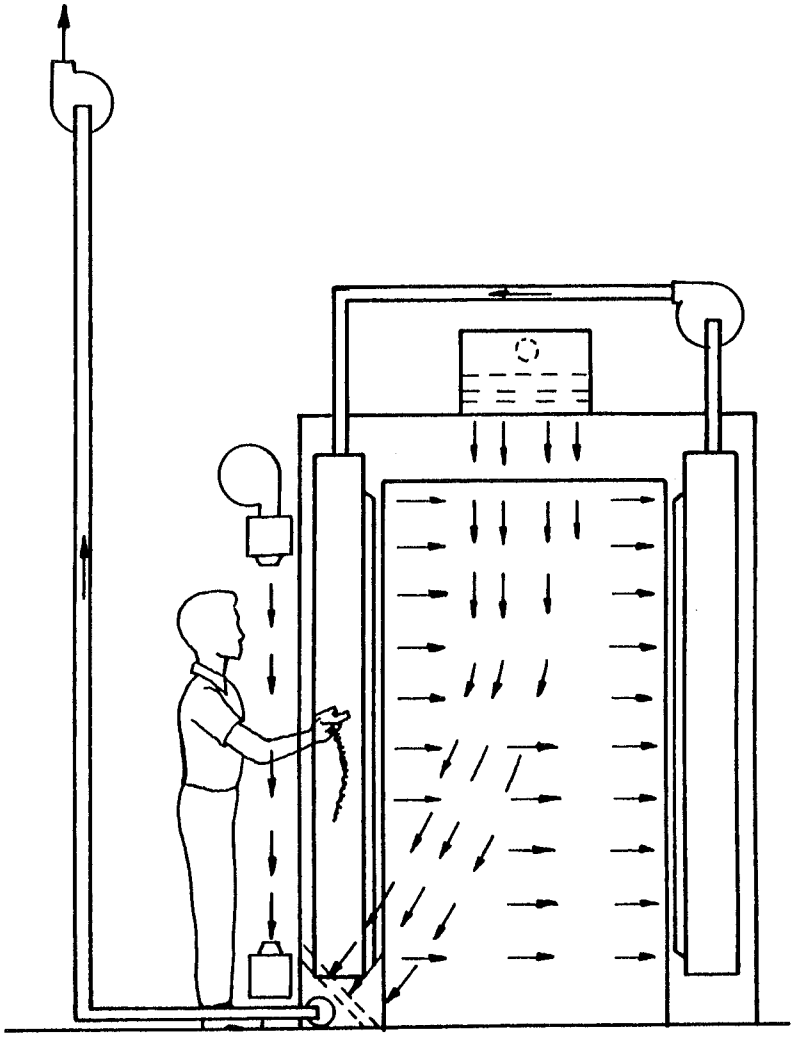
FIG. 12 is an end elevational and schematic view of another embodiment of the control system comprising the present invention having an above floor single air flow exhaust and a recirculatory air curtain design to seal the spray booth worker's access opening.
Figure 11:
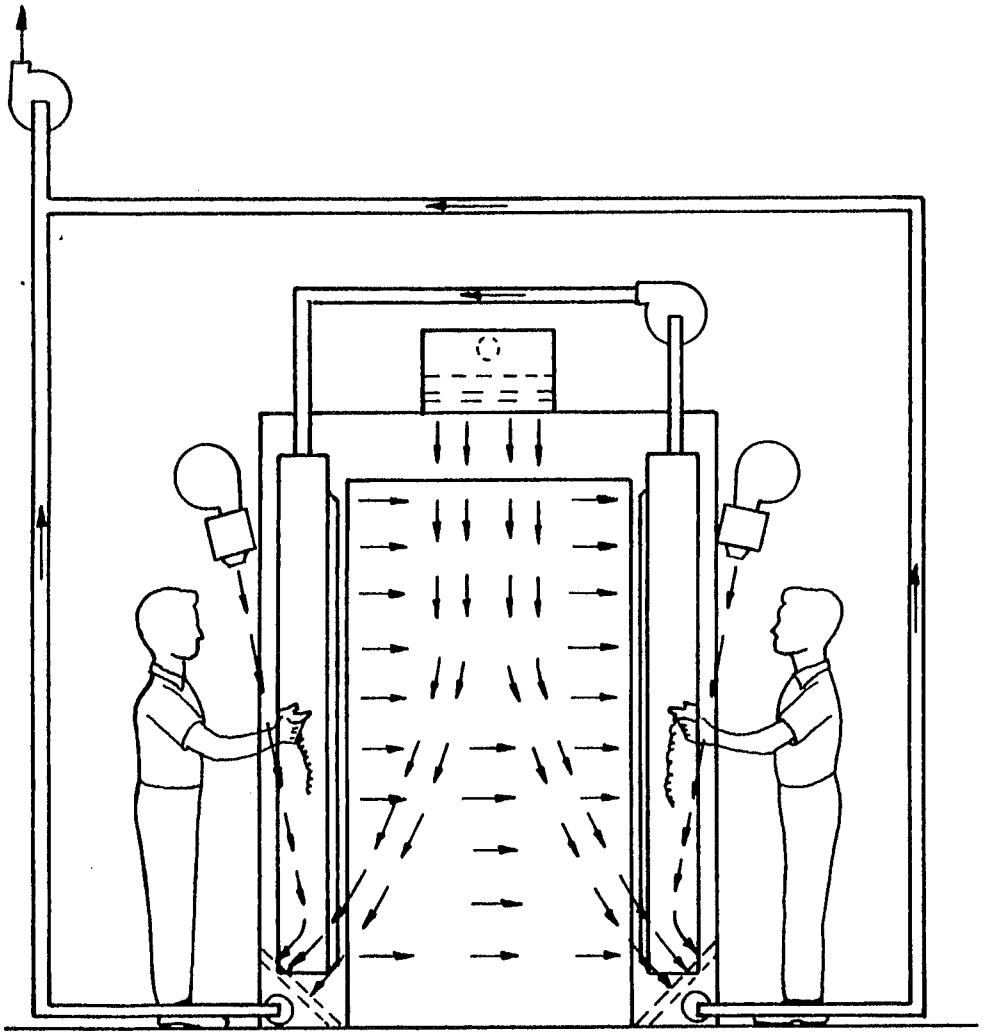
FIG. 11 is an elevational and schematic view of another embodiment of the control system comprising the present invention utilizing an above floor dual air flow and substance exhaust wherein the air curtain air flow enters that return.

A plenum 36 is preferably mounted in the top of spray booth housing 24 so that it can receive flow from an air flow source fan 38, and direct the air flow generally downward as shown in FIGS. 7 and 8. Perforations 40 in the plenum baffle 39 encourage an even and consistent spread of air flow downwardly through the interior of spray booth 20 thereby entraining vapor and spray particles (VOC's and other substances) and moving these downwardly away from the spraying operator42 working nearby. The plenum functions very satisfactorily if mounted in the middle of the top of the spray tunnel, however it is clearly apparent that it can be positioned in other locations and function acceptably.

Air evacuation from the interior of spray booth 20 is accomplished in the embodiment shown in FIGS. 7, 8, 13 and 14 by utilizing an air return conduit 43 through which air is pulled by fan 44. Air flowing downwardly from plenum 36 moves into return conduit 43 through an opening 46 (FIG. 7) near the floor of the spray booth housing 24 and may be positioned within a collecting duct 48 equipped with a suitable filter 50. Two returns, one on each side of spray booth 20, may be utilized to achieve an evenly distributed air flow pattern within the interior of housing 24.

Since the primary function of the present invention is to control VOC's and other substances so that they can be collected, exhausted and disposed of, the evacuation process controlled by fan 44 moves the entrained substances eventually to a thermal oxidizer 52 where they are removed from the air stream.

Prior art suspended material controlling devices have been extremely expensive because of the large volume of air required to be used to deal with a small concentration of contaminants and ensure that they are carried away from human contact. The essence of the present invention's ability to reduce the air volume significantly and efficiently manage the collection and incineration of VOC's and other substances is the use of air curtains 26, 28 at strategic locations around the spray booth 20. Air curtains 26, 28 can be of a recirculatory design or can be separately created but exhausted through the air evacuation structure of the interior air flow and VOC return and on to the thermal oxidizer 52. The side air curtains 28 are located to effectively seal the VOC's and other substances inside the spray booth interior which might otherwise pass through opening 34 of housing 24. In a recirculatory system such as shown in FIG. 13, fan 54 circulates air from the upper manifold 56 evenly and dowardly in a thin curtain to receiver 58 from which it is pulled by fan 54 through conduit 60 for recirculation. The thin air stream forming the air curtain enables the operator 42 to extend its hands and spray gun through the curtain and effectively perform spraying or painting operations on the article contained within the interior of spray booth 20. Tests have shown that the air curtain effectively seals around the arms of the operator without causing any discomfort and effectively prevents the flow of VOC's or other materials from the interior of the spray tunnel to the surrounding environment.

Figure 2:
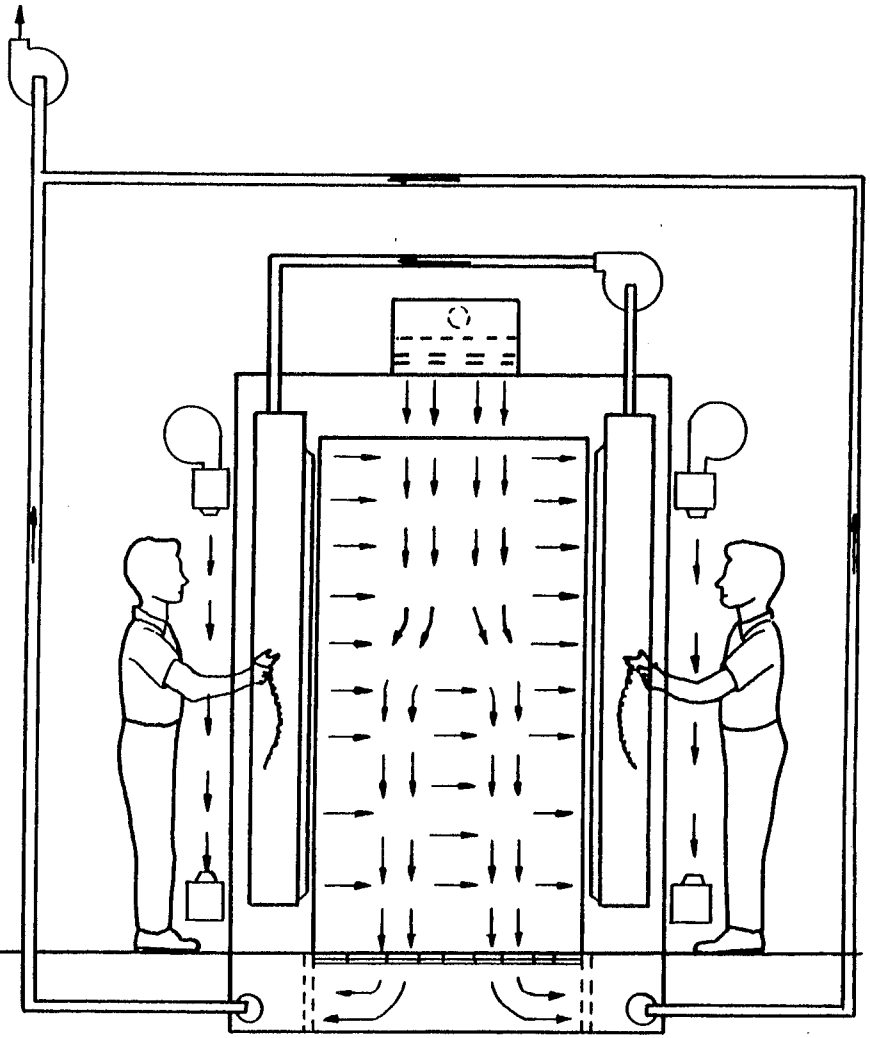
FIG. 2 is an end elevational view and schematic view shown in FIG. 1 utilizing two spraying operators in a face to face relationship.
Figure 1:
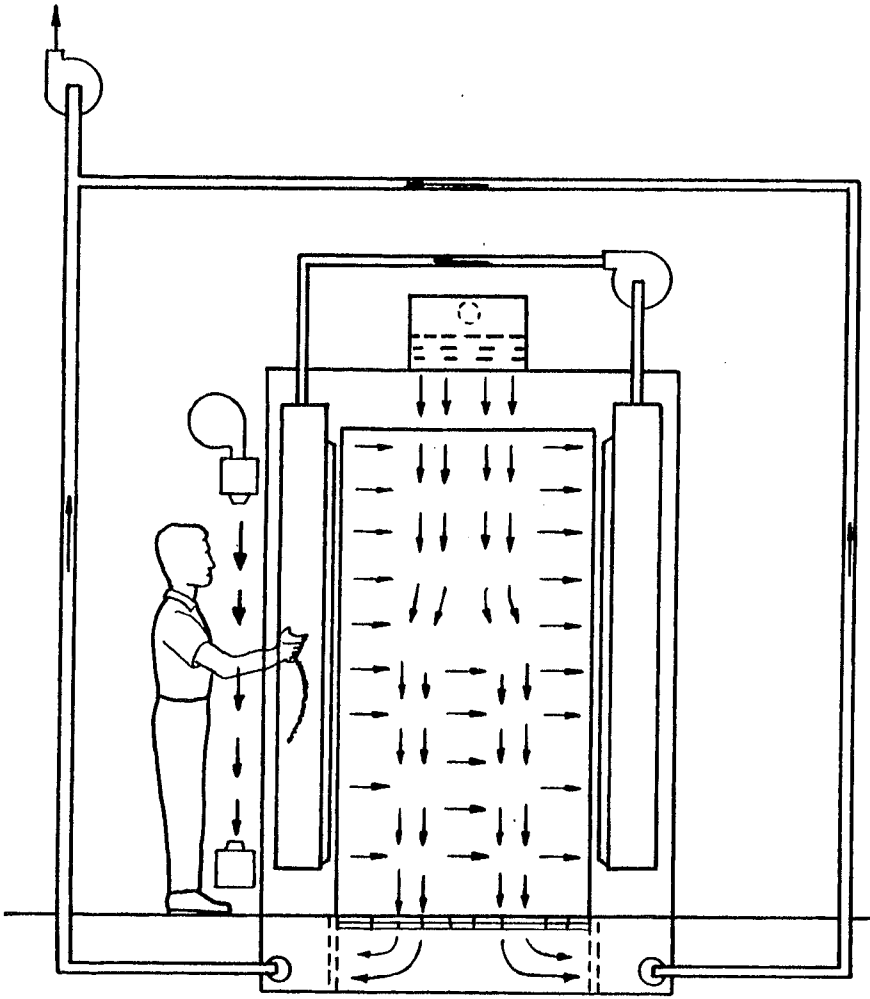
FIG. 1 is an end elevational and schematic view of one embodiment of the control system comprising the present invention utilizing a below floor level dual air flow and substance exhaust and a single spraying operator.
Figure 4:
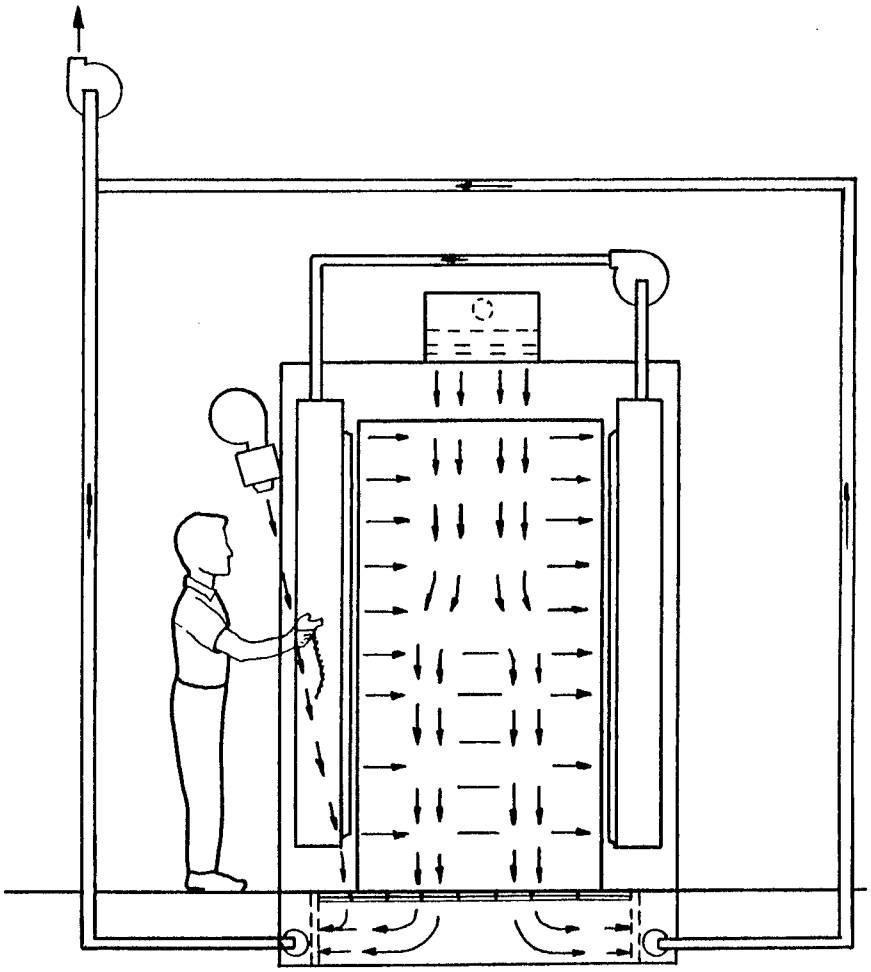
FIG. 4 is an end elevational and schematic view of another embodiment of the control system comprising the present invention utilizing a below floor level dual air flow and substance exhaust wherein the air curtain air flow enters that return.
Figure 3:
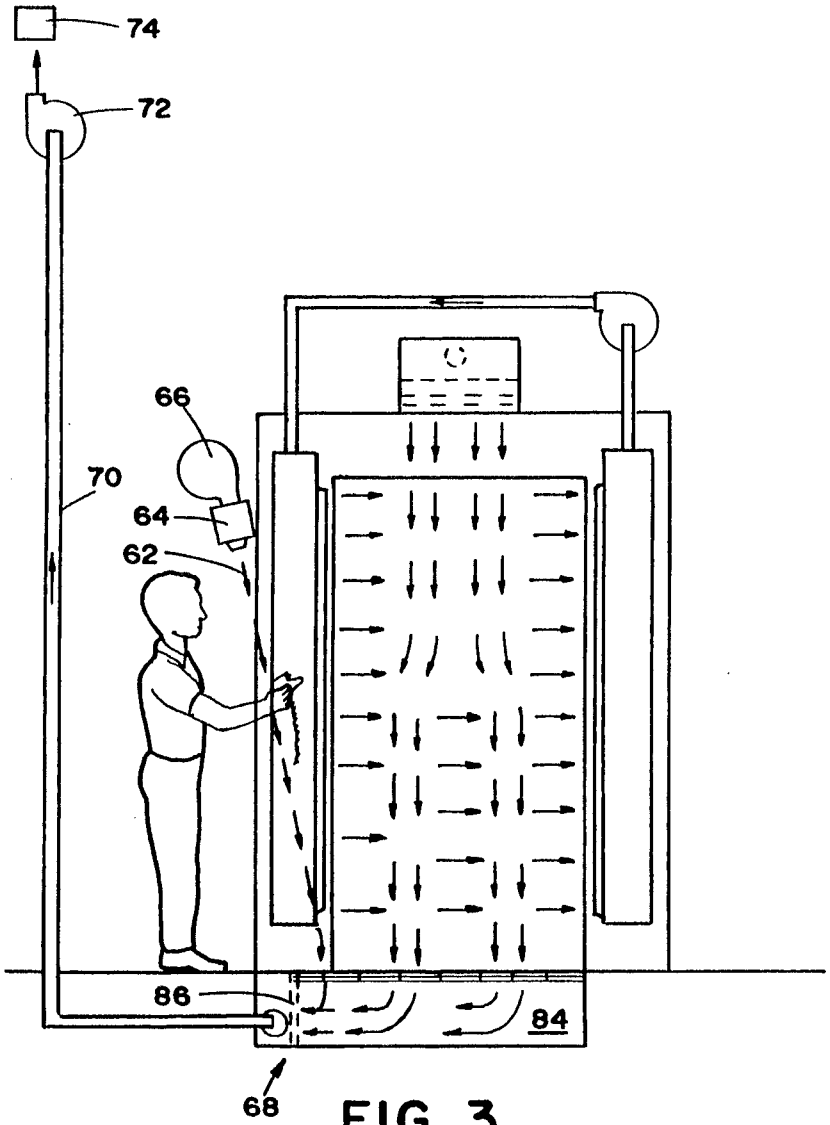
FIG. 3 is an end elevational and schematic view of the control system comprising the present invention showing a single air flow and substance return wherein the air curtain air flow enters that return.
Figure 5:
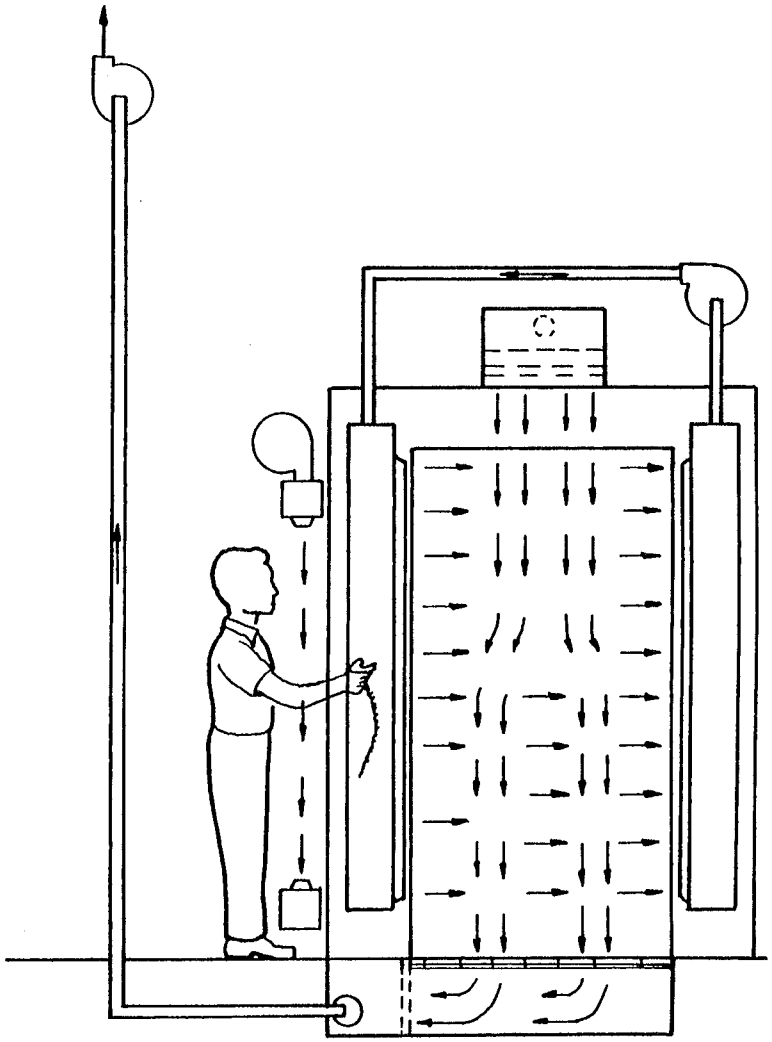
FIG. 5 is an end elevational and schematic view of another embodiment of the control system comprising the present invention utilizing a below floor single air flow and substance exhaust and a recirculatory air curtain design to seal the spray booth worker's access opening.
Figure 6:
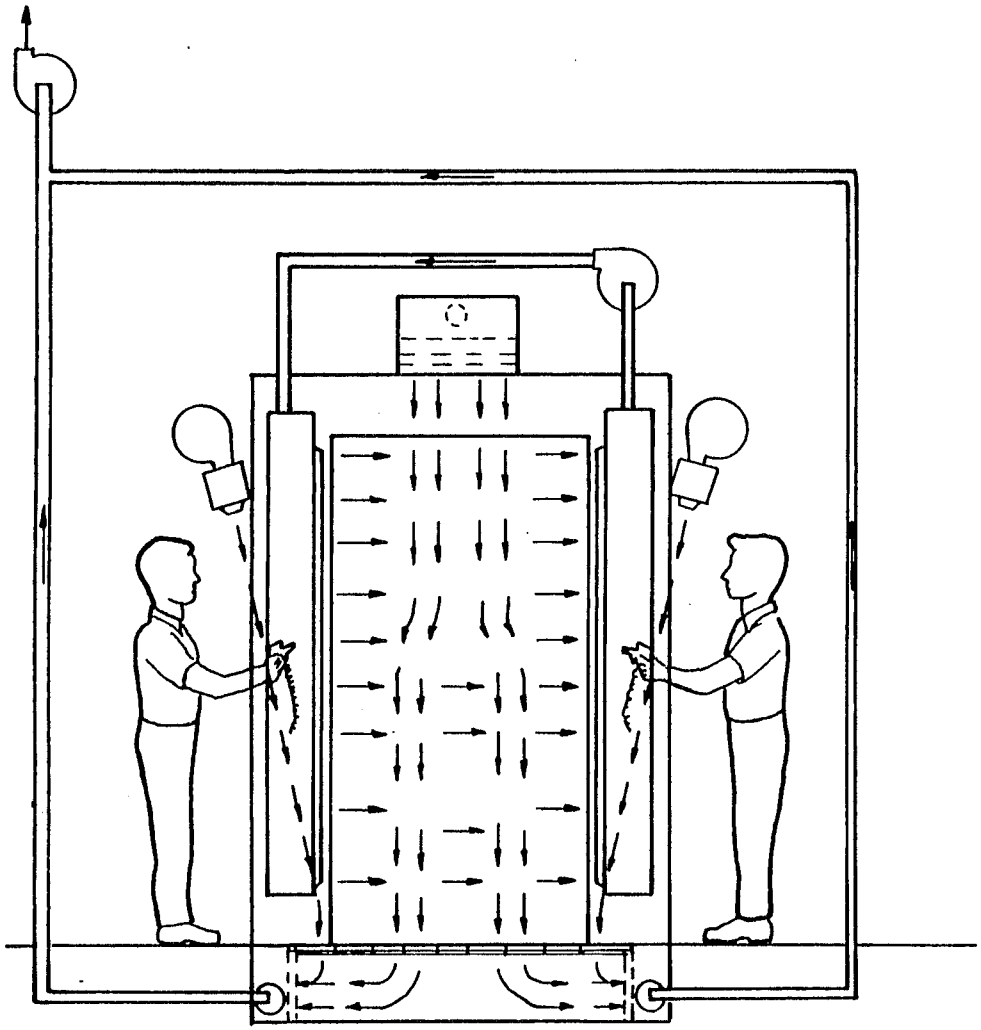
FIG. 6 is an end elevational and schematic view of another embodiment of the control system comprising the present invention having a below floor dual air flow and substance exhaust and the air curtain return shown in FIG. 4.

FIGS. 3 and 4 show an alternative housing opening air curtain 62 which utilizes an air curtain reservoir 64 supplied by fan 66. Rather than having a separate air curtain receiver as shown in FIGS. 7 and 8, air curtain air flow is collected in the air evacuation system shown generally as 68. Thus the air curtain return combines with the interior air and substance flow and is moved through conduit 70 by fan 72 and on to thermal oxidizer 74. In this example the air curtain air supply is pulled directly from the exterior air surrounding the spray booth rather than being recirculated as occurs in the recirculatory system.

Air curtains 26 (FIGS. 7, 8, 13 and 14) cover the openings to the spray booth serving as entrance 30 and exit 32 to again effectively seal VOC's and other substances within spray booth 20 and prevent them from escaping into the atmosphere surrounding the booth. The air curtain manifold 76 emits air in a thin stream horizontally (see arrows) to collector 78 from where it is pulled by fan 80 through conduit 82 for recycling. For the entrace 30 and exit openings covered by the horizontally flowing air curtains, the recirculatory system appears to be the most advantageous.

Air and suspended substance evacuation can be achieved by a variety of air flow and return structures within the spray booth housing 24. FIGS. 7 and 8 show air and substance evacuation taking place above ground level by forming a collecting device 48 on the floor of the spray booth. In FIG. 3, an evacuation system is developed by utilizing a channel 84 in the floor of supporting surface 22 connecting conduit 70 thereto. Air flow then passes through a filter 86 and on through conduit 70 to thermal oxidizer 74. In this air evacuation system, a single air return (FIG. 3) or a double air return (FIG. 4) can be used with equal effectiveness.

Figure 16:
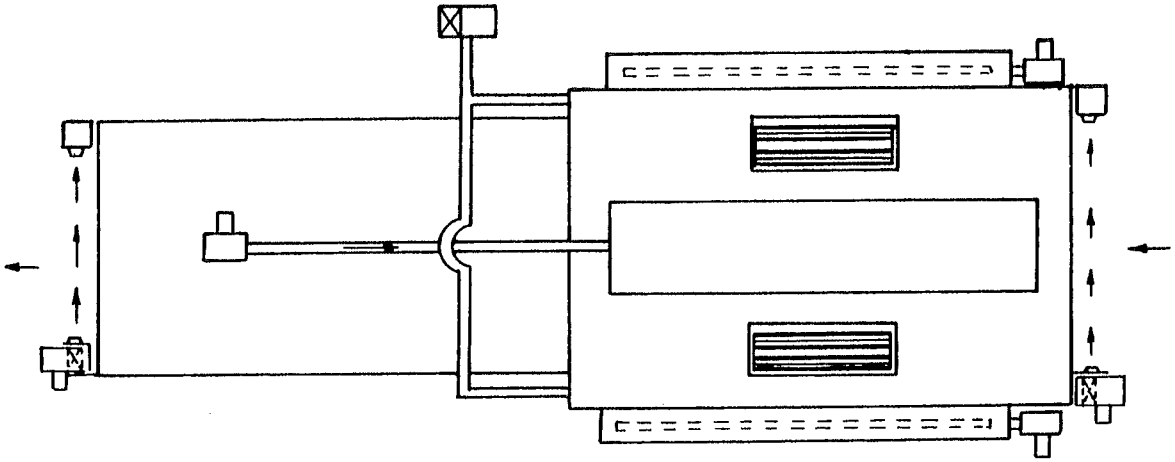
FIG. 16 is a plan and schematic view of the embodiment of the control system comprising the present invention shown in FIG. 15.
Figure 15:
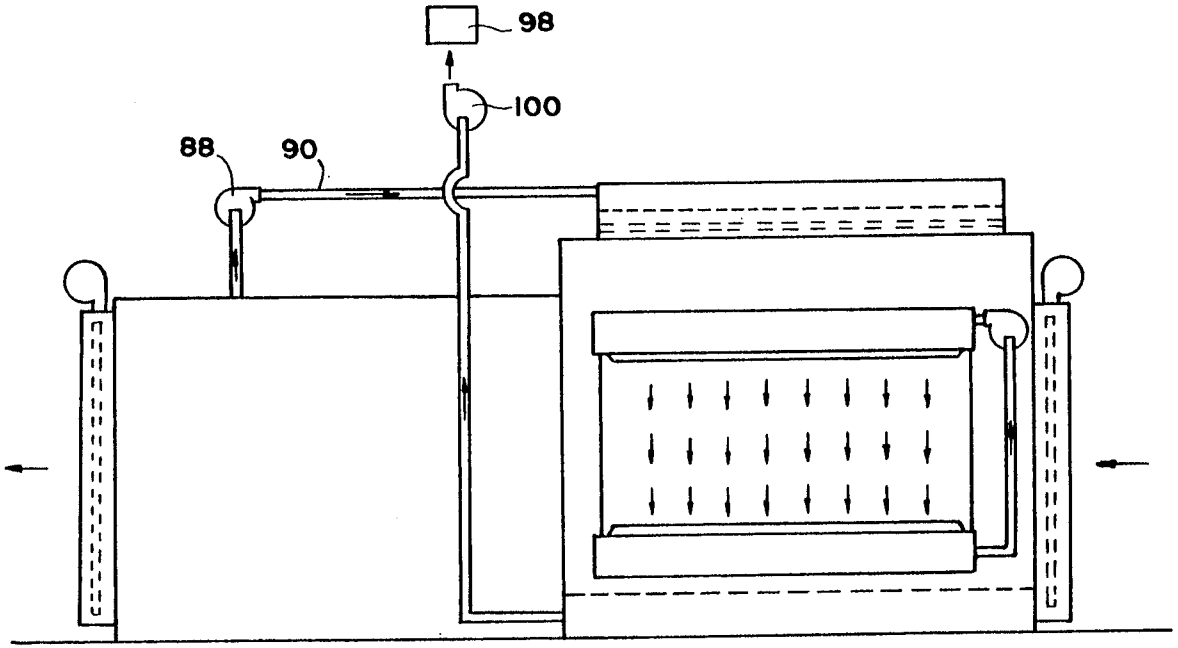
FIG. 15 is a side elevational and schematic view of another embodiment of the control system comprising the present invention having a large area adjacent the working area designated as a flash tunnel to receive the sprayed article when it has been removed from the spray booth interior air flow.

In the embodiment of the present invention shown in FIG. 15, one of the adjacent areas is a flash tunnel where VOC's and other substances are emitted from the painted article shortly after the spraying process has been completed and are then entrained in the supplied air. In using a structure of this nature, it has been found more efficient to remove the air from the flash tunnel by fan 88 through conduit 90 and on to plenum 92. The basic air flow evacuation system is retained by removing substance-entrained air flow from the interior of spray booth 94 through a collecting means 96 like those previously discussed and on to the thermal oxidizer 98 through the action of fan 100. Again, a single or dual evacuation system may be used; FIG. 16 illustrates such a dual system.

Figure 17:
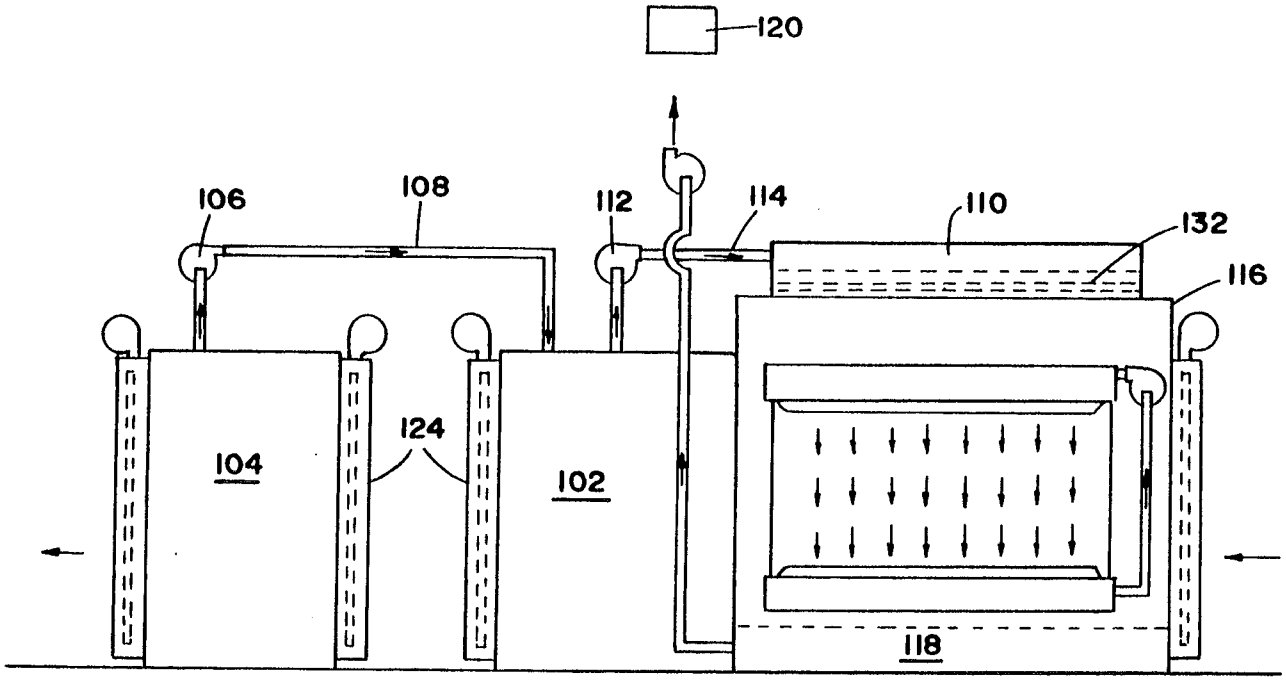
FIG. 17 is a side elevational and schematic view of another embodiment of the control system comprising the present invention having another area adjacent the working and related area designed to function as a drying oven.
Figure 18:
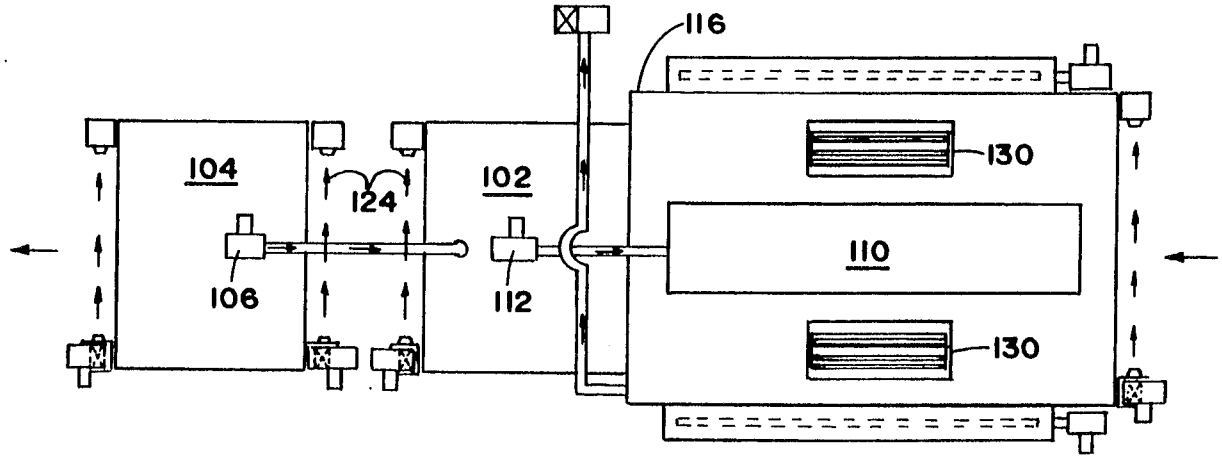
FIG. 18 is a plan and schematic view of the embodiment of the control system comprising the present invention shown in FIG. 17.
Figure 19:
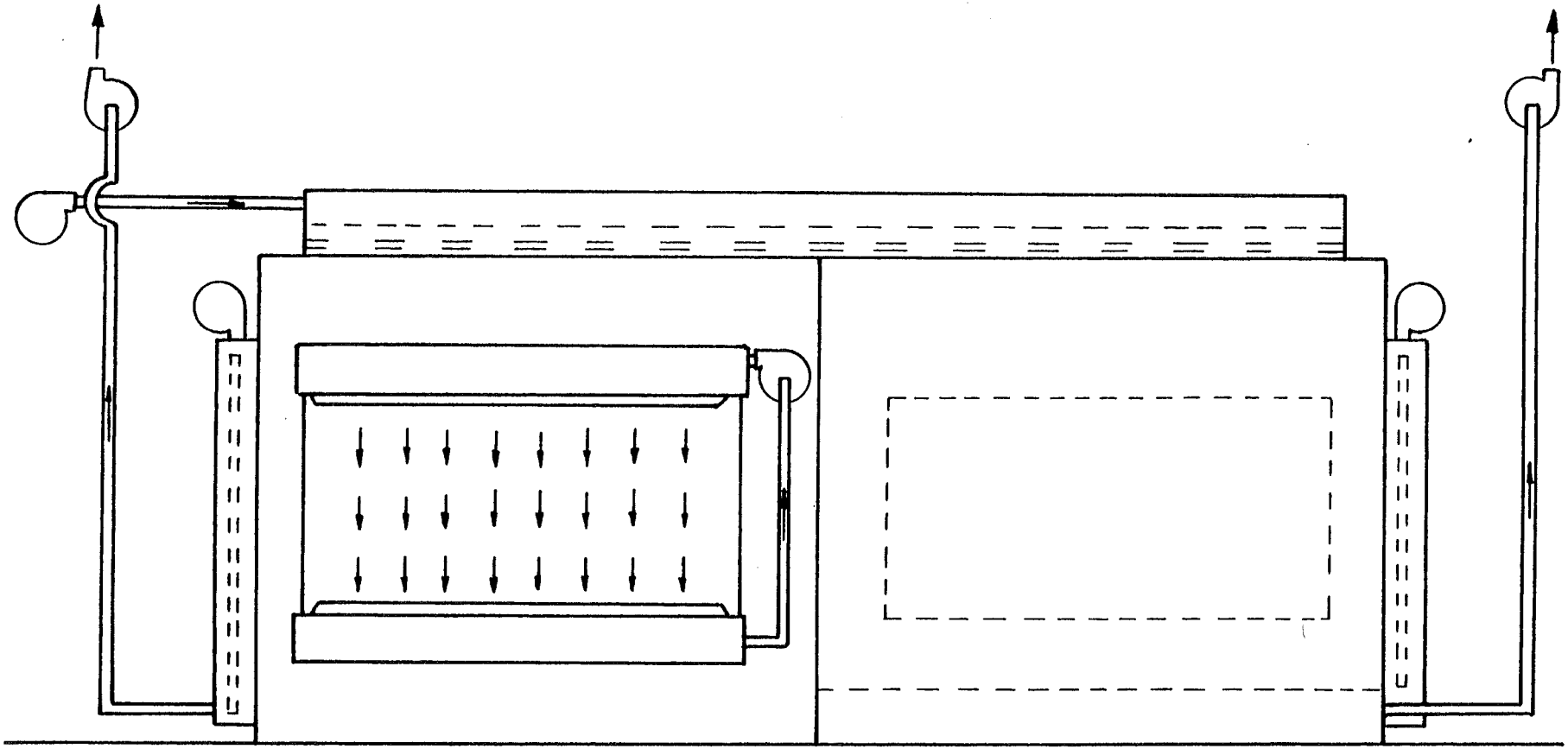
FIG. 19 is a side elevational and schematic view of the control system comprising the present invention showing two spray booths in tandem to permit the positioning of a sprayer on either side of the article being sprayed.
Figure 20:
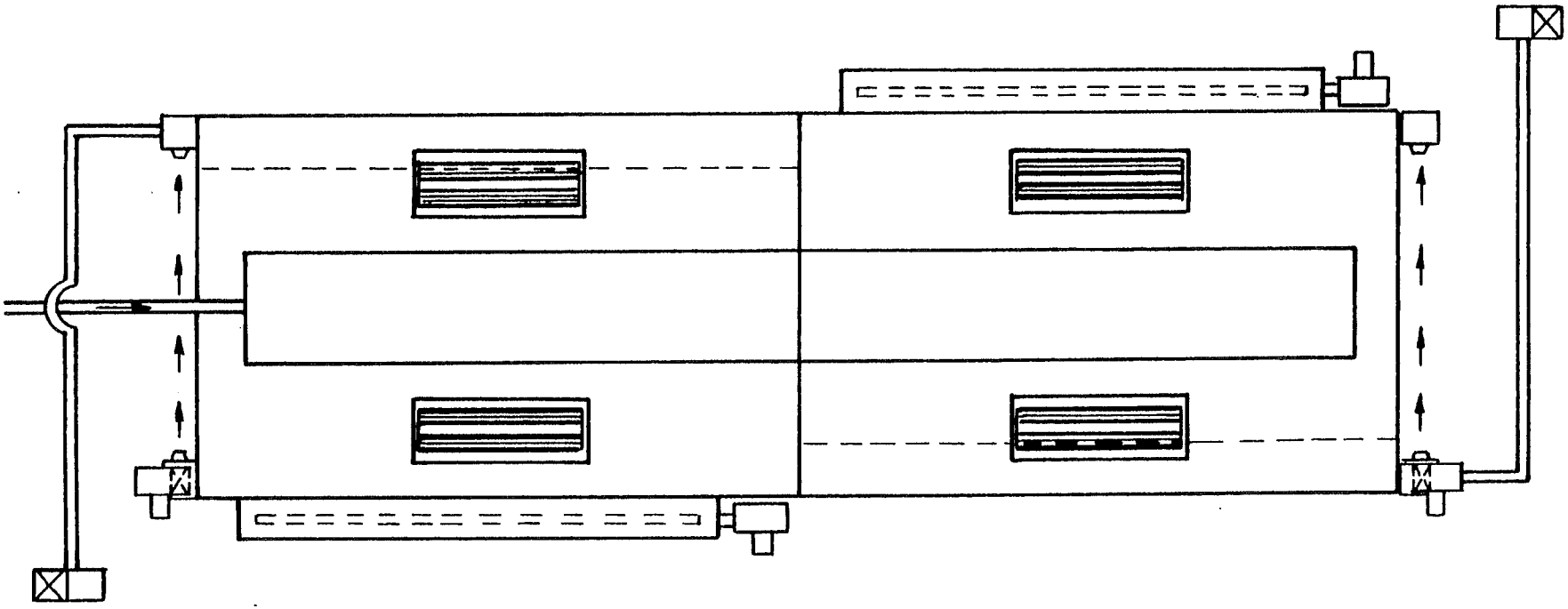
FIG. 20 is a plan and schematic view of the embodiment of the control system shown in FIG. 19.

The present invention has been extended to yet another, even more efficient, embodiment which is shown in FIGS. 17 and 18. Here the adjacent areas have been extended to include flash tunnel 102 and oven 104. As the sprayed article dries at higher temperatures over a period of time, the air surrounding the drying article is evacuated from oven 104 by fan 106 and moved back to flash tunnel 102 through conduit 108. Air again is moved back to plenum 110 by fan 112 through conduit 114. Air flow and substance evacuation within the interior of spray booth 116 is through the collecting means 118 and on to thermal oxidizer 120 where it is ignited and destroyed. The evacuation system can again be either single or dual, FIG. 18 illustrating a dual system return.

Additional air curtains 124 can be used to separate adjacent areas formed by flash tunnel 102 and oven 104 as shown in FIGS. 17 and 18.

In operating the system discussed herein, it has been found effective and efficient to provide air flow in the entrance, exit and side air curtains of from approximately 400 to 500 cfm. Air flow within these ranges provide effective seals against the flow of VOC's and other substances from the interior of the spray booth to the surrounding environment. Small, relatively inexpensive fans can be used to provide necessary air flow thus making the application of air curtains to achieve suspended material containment quite attractive.

In considering the air flow supply means for directing air flow inside the spray booth, it has been found that a flow of approximately 500 cfm for ten feet of spray booth length will achieve satisfactory results. Thus an air flow of approximately 2000 cfm would be required for a ten foot booth and approximately 5000 cfm supply for a thirty foot booth. This is in marked contrast with an air flow requirement of approximately 40,000 cfm in a conventional system for a booth of 30 feet in length not utilizing the air curtain sealing means of the present invention.

Other features can be added to the system comprising the present invention such as interior lights 130 and additional filters 132 in plenum 134.

From this detailed description, it can be seen that a suspended substance control system has been provided that will meet all of the advantages of the prior art and offer additional advantages not offered by the prior art. Small volumes of air can be utilized to effectively collect and ignite VOC'S and other substances which would, absent the present inventive concept, normally require significantly higher air flow and expensive operative equipment. Additional advantages result from the less expensive structure required to utilize air curtains as containment devices since side walls of spray tunnels are non-existent. In all cases, low horsepower fans can be utilized to create the necessary air flow in sharp contrast to the high horsepower fans needed for high air volume flow in conventional devices.

With respect to the above description, it is to be realized that the optimum dimensional relationship for the parts of the invention, to include variations in size, materials, shape, form, function, and manner of operation, asembly and use, are deemed readily apparent and obvious to one skilled in the art, and all equivalent relationships to those illustrated in the drawings and described in the specification are intended to be encompassed herein.

Therefore, the forgoing is considered as illustrative only of the principals of the invention. Since numerous modifications and changes will readily occur to those skilled in the art, it is desired not to limit the invention to the exact description and operation of the embodiment shown. All suitable modifications and equivalents that fall within the scope of the appended claims are deemed within the present inventive concept.

What is claimed as being novel and deserving to be protected by Letters Patent of the United States is as follows:

1. A control system comprising: a spray booth having an entrance, an exit, an accessible working area, and an one or more areas adjacent thereto; air curtain means providing an invadable spray booth sealing closure for the entrance, exit, working area and adjacent areas; interior air flow supply means directing air flow in the direction of the article to be sprayed; air evacuation means removing the supplied air, VOC's and other substances entrained therein from the working and adjacent areas to a remote location; and means positioned at the remote location to remove the evacuated VOC's and other substances.

2. The system as described in claim 1 wherein the air curtain means retains the interior air flow, VOC'S and other substances within the working area and adjacent area until they are removed to the remote location and removed.

3. The system as claimed in claim 2 wherein the air evacuation means includes air flow passages adjacent the spray booth preselectively postioned to collect the supplied air, entrained VOC'S and other substances and direct their flow to the remote location for removal.

4. The system as claimed in claim 2 wherein the interior air flow supply means is one or more fans directing air flow generally toward the article to be sprayed.

5. The system as claimed in claim 2 wherein the air curtain means includes one or more curtain arrangements preselectively located to seal the entrance, exit, working area and adjacent area to prevent movement therethrough of the supplied air, entrained VOC's and other substances from the working area and adjacent area.

6. The system as claimed in claim 5 wherein each of the air curtain arrangements has an air curtain emitting manifold, an air curtain collector, air flow connecting elements joining the manifold and collector, and air circulatory means operably positioned with respect to the manifold, collector, and connecting elements.

7. The systems as claimed in claim 5 wherein the spray booth entrance air current arrangement has the air emitting manifold and curtain collector positioned to create an air curtain having horizontal air flow.

8. The system as claimed in claim 7 wherein the spray booth exit air current arrangement has the air emitting manifold and curtain collector positioned to create an air curtain having horizontal air flow.

9. The system as claimed in claim 5 wherein each of the spray booth working area and adjacent area air curtain arrangements has the air emitting manifold and curtain collector positioned to create an air curtain having vertical air flow.

10. The system as claimed in claim 4 wherein the air flow directing fan or fans are positioned above the article to be painted.

11. The system as claimed in claim 3 wherein the air curtain means includes one or more air curtain arrangements preselectively located to seal the entrance, exit, working and adjacent areas to prevent movement therethrough of the supplied air, entrained VOC's and other substances from the working area and adjacent area, each of the air curtain arrangements having an air emitting manifold, an air curtain collector, air flow connecting elements joining the manifold and air curtain collector, and air circulatory means operably positioned within the air flow connecting elements, the air flow passages functioning as the curtain collector to direct air curtain air flow through the air flow passages with the supplied air, entrained VOC's and other substances to the remote location thereby disposing of any entrained VOC's and other substances in the air flow curtain.

12. The system as claimed in claim 2 wherein a sprayer has access to the working area and the adjacent area by extending the spraying device through the air curtain to spray the article to be sprayed without allowing the escape of supplied air, entrained VOC's and other substances.

13. The system as claimed in claim 12 wherein sprayer access is on each side of the article to be painted.

14. The system as claimed in claim 3 wherein the air flow passages are located on each side of the article to be sprayed.

15. The systems as claimed in claim 2 wherein the adjacent area includes a flash tunnel where VOC's and other substances are emitted from the sprayed article and entrained in the supplied air immediately after spraying has been completed.

16. The system as claimed in claim 15 wherein the supplied air, entrained VOC'S and other substances are evacuated therefrom and moved to the remote location for removal.

17. The system as claimed in claim 15 wherein the adjacent area further includes an oven wherein the sprayed article is dried, the flash tunnel and oven are connected by air flow inducing means, and supplied air, VOC's and other substances from the oven dried article are moved to the remote location for ignition.

18. The system as claimed in claim 4 wherein the air flow generated from the interior air flow supply means is from about 2,000 cfm to about 5,000 cfm.

19. The system as claimed in claim 5 wherein the air flow of the air curtain arrangements is from about 300 cfm to about 600 cfm.

20. The system as claimed in claim 11 wherein the air flow generated from the interior air flow supply means is from about 2000 cfm to about 5000 cfm.

21. The system as claimed in claim 5 wherein the air flow of the air current arrangements is from about 300 cfm to about 600 cfm.

22. The system as claimed in claim 20 wherein the air flow of the air current arrangments is from about 300 cfm to about 600 cfm.

23. A control system comprising: a spray booth having an entrance, an exit, and accessible working area and one or more areas adjacent thereto; air curtain means providing an invadable spray booth ceiling closure for at least the entrance, exit, and working areas; interior air flow supply means directing air flow in the direction of the article to be sprayed; air evacuation means removing the supplied air, VOC'S and other substances entrained therein from at least working area to a remote location; and means positioned at the remote location to remove the evacuated VOC's and other substances.

* * * * *